US008347509B2

(12) United States Patent
Votolato

(10) Patent No.: US 8,347,509 B2
(45) Date of Patent: Jan. 8, 2013

(54) UTILITY TOOL HAVING INTERCHANGEABLE TOOL CARTRIDGES

(75) Inventor: Earl Votolato, Newport Beach, CA (US)

(73) Assignee: Votolato Living Trust, Newport Beach, CA (US)

( * ) Notice: Subject to any disclaimer, the term of this patent is extended or adjusted under 35 U.S.C. 154(b) by 541 days.

(21) Appl. No.: 12/391,729

(22) Filed: Feb. 24, 2009

(65) Prior Publication Data

US 2009/0172889 A1 Jul. 9, 2009

Related U.S. Application Data

(63) Continuation-in-part of application No. 12/319,677, filed on Jan. 9, 2009, now Pat. No. 8,099,868, which is a continuation-in-part of application No. 10/818,661, filed on Apr. 5, 2004, now Pat. No. 7,475,480.

(51) Int. Cl.
*B26B 11/00* (2006.01)
*B26B 3/00* (2006.01)

(52) U.S. Cl. ..... 30/156; 30/151; 30/342

(58) Field of Classification Search ..... 30/151–164, 30/293–294, 286, 349, 332–333, 342, 312, 30/142, 147; 7/167, 168, 158
See application file for complete search history.

(56) References Cited

U.S. PATENT DOCUMENTS

| | | | | |
|---|---|---|---|---|
| 4,757,612 | A * | 7/1988 | Peyrot | 30/151 |
| 5,342,379 | A | 8/1994 | Volinsky | |
| 5,806,189 | A * | 9/1998 | Bailey | 30/125 |
| 5,829,082 | A | 11/1998 | Moreira | |
| 5,878,501 | A * | 3/1999 | Owens et al. | 30/286 |
| 5,933,918 | A | 8/1999 | Wallays | |
| 6,276,014 | B1 * | 8/2001 | Lee | 7/158 |
| 6,578,266 | B2 * | 6/2003 | Chomiak | 30/2 |
| 6,718,640 | B1 | 4/2004 | John | |
| 7,024,772 | B1 * | 4/2006 | Shaver et al. | 30/2 |
| 7,114,824 | B2 | 10/2006 | Picone | |
| 7,784,189 | B2 * | 8/2010 | Polei | 30/162 |
| 8,122,605 | B2 * | 2/2012 | Votolato | 30/2 |
| 2008/0083119 | A1 * | 4/2008 | Schmidt | 30/162 |
| 2008/0229585 | A1 * | 9/2008 | Kelly | 30/125 |
| 2010/0263219 | A1 * | 10/2010 | Kempker et al. | 30/337 |

FOREIGN PATENT DOCUMENTS

EP 0998374 11/2003

OTHER PUBLICATIONS

Kempker, J.A., et al., "Cutter with Replaceable Head", U.S. Appl. No. 61/138,262, filed Dec. 17, 2008.

* cited by examiner

*Primary Examiner* — Laura M. Lee
(74) *Attorney, Agent, or Firm* — Fish & Associates, PC

(57) ABSTRACT

A tool system is presented. The tool system includes a tool body sized and dimensioned to fit comfortably in a human hand, and includes a plurality of interchangeable tool cartridges. Some of the tool cartridges include a tool bit cover capable of remaining in a closed, locked position sheathing a tool bit. Once installed, the tool bit cover can be unlocked via actuation of a trigger disposed on the body of the tool or on the cartridge. Preferably, the tool bit cover unsheathes the underlying tool bit due to pressure or force of a work surface.

25 Claims, 9 Drawing Sheets

UTILITY TOOL HAVING INTERCHANGEABLE TOOL CARTRIDGES

This application is a continuation-in-part of U.S. patent application having Ser. No. 12/319,677 filed on Jan. 9, 2009, which in turn is a continuation-in-part of U.S. patent application having Ser. No. 10/818,661 filed on Apr. 5, 2004, which is now U.S. Pat. No. 7,475,480 issued on Jan. 13, 2009. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is hand held tool technologies.

BACKGROUND

Known utility knifes allow for replacing a dull or used blade with a new blade. However, replaceable blades have exposed cutting edges, which pose a risk to the individual replacing the blade. If the individual lacks sufficient care, they could easily cut themselves on the blade during the replacement operation.

Some effort has been directed toward protecting individuals when replacing blades of various knifes. For example, U.S. Pat. No. 5,342,379 to Volinsky titled "Safety Scalpel" (June 1993) describes a scalpel having disposable blade cartridges for use with a permanent scalpel handle. A scalpel blade in a cartridge remains retracted within housing during a replacing operation. However, when in use the blade can be locked in an exposed position, which is likely useful to a surgeon. Unfortunately locking a blade in an exposed position during use of a utility knife poses a risk to the user because the user could still injure themselves or others. A more comprehensive method of protecting the user is still required.

Another, better approach that would offer greater protection includes integrating a moveable blade cover into a blade cartridge where the cover remains closed when the cartridge is not in use. Such a cartridge can be securely installed within or on a tool handle to provide a solid, useable, and safe cutting tool. The blade cover can be controlled through an actuator that releases or otherwise unlocks the blade cover to allow use of the blade. The cartridge can be inexpensively manufactured, and could be considered a disposable unit.

Furthermore, the handle and cartridge system should provide a foundation for multi-function tool system where many different cartridges can be produced, each with a different type of tool bit (e.g., knife blade, screw driver, pliers, light, etc.). Each cartridge can be installed on a common tool handle.

U.S. Pat. No. 5,933,918 to Wallays titled "Handle with Interchangeable Kitchen Implements" (September 1997) discusses a kitchen utensil having interchangeable implements, many of which have exposed cutting edges. Interestingly, Wallays mentions that a brush utensil could have a separate component that operates as a protective sleeve for a brush, but lacks such protection for cutting implements. One should also note the contemplated interface between the implements and the handle has mechanically many weak points, which can become fatigued through minimal use, and eventually break. Wallays fails to appreciate the each type of implement would likely be better served having a different tool interface more inline with the intended use of the implement.

European patent application EP 0 998 374 to Nabors et al. titled "Foldable Tool with Removable Tool Cartridges" (July 1998) also describes a multi-function tool. However, the Nabors approach merely places multiple tools within a single removable cartridge. The contemplated tools also lack covers and are expensive to manufacture. Should a tool break, the entire multi-tool cartridge would require fixing or replacing as opposed to replacing a single damaged tool bit.

Yet another example of a multi-function tool includes U.S. Pat. No. 5,829,082 to Moreira titled "Multi-Functional Hand Tool" (March 1997). Moreira provides for a tool handle capable of supporting different types of tool attachments. As with the previous references, Moreira lacks any provisions for a tool cover to protect a user during use of the tool.

Further progress was made by U.S. Pat. No. 7,114,824 to Picone titled "Multi-Functional Tool with Interchangeable Adjustable Wrench Head Unit" (May 2004). Picone, describes yet another multi-functional tool where many different types of tool heads (e.g., wrench, light, screw driver bits, wrench sockets, etc.). As with the previous reference, Picone also fails to contemplate that some tool heads require a tool bit cover.

A desirable multi-function tool system should provide for many different types of tools as well as provide for protecting the user of the tool, or for protecting the tool bits with a lockable tool bit cover when the tool is not in use. For example, a tool system should include low cost, possibly disposable, knife blade cartridges having blade covers, or cartridges supporting other types of tool bits. Advantages for such a system become quite clear. Cartridges having lockable tool bit covers aid in preventing users from becoming injured when the tool is in use, when the tool bit is replaced, or when the tool bit is discarded.

Thus, there is still a need for a hand-held tool system having multiple interchangeable tool cartridges where the cartridges can have a tool bit cover that remains closed when not in use.

SUMMARY OF THE INVENTION

The inventive subject matter provides apparatus, systems and methods in which a multi-function tool has a main body and multiple interchangeable tool cartridges, where some of the tool cartridges are configured to interoperate with portions of the tool body. One aspect of the inventive subject matter includes a tool system that includes interchangeable tool cartridges. Each cartridge preferably comprises a cartridge assembly of a tool bit, a tool bit holder, and a fastener that securely attaches the cartridge to the body of the tool. In a preferred embodiment, cartridges assemblies can include a tool bit cover that can sheath the tool bit. The tool bit cover is preferably biased closed, possibly locked, when not in use, and unlocks upon actuation of a trigger. In some embodiments, actuation of the trigger allows the cover to be unlocked for a single use and locks back into a closed position after use. The trigger can be located within the body of the tool or on the cartridge assembly.

The fasteners of the cartridge assemblies can be of many different types. In some embodiments, the fastener can include a dove-tail assembly, a snap-lock, a screw fastener, a stem that inserts into the body, or other types of fastener. It is also contemplated that a common tool body can include support for interfacing with different cartridges having different types of fasteners. The tool body could, for example, include complementary fasteners for cartridges having dove-tail fasteners or for screw fasteners. Such an approach provides an advantage where a tool cartridge can have a fastener that best matches the intended use of the cartridge. A utility knife cartridge would likely be better served with a snap-lock or a stem type of fastener while a screw-driver cartridge would likely operate more efficiently with a dove-tail fastener. In both cases, two cartridges having different types of tool bits can be installed on the same tool body utilizing their respective complementary fasteners.

Contemplated tool cartridges can include tool bits of different types. The different types of tool bits can include cutting tool bits (e.g., on or more blades, knifes, scrappers, scissors, chisels, etc.), rotating tool bits (e.g., drills, screw driver heads, etc.), gripping tool bits (e.g., pliers, wrench, etc.), lighting tool bits (e.g., magnifying glass, lights, etc.), marking tool bits (e.g., markers, pencils, pens, etc.), dispensing tool bits (e.g., tape, chalk, etc.), or others.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
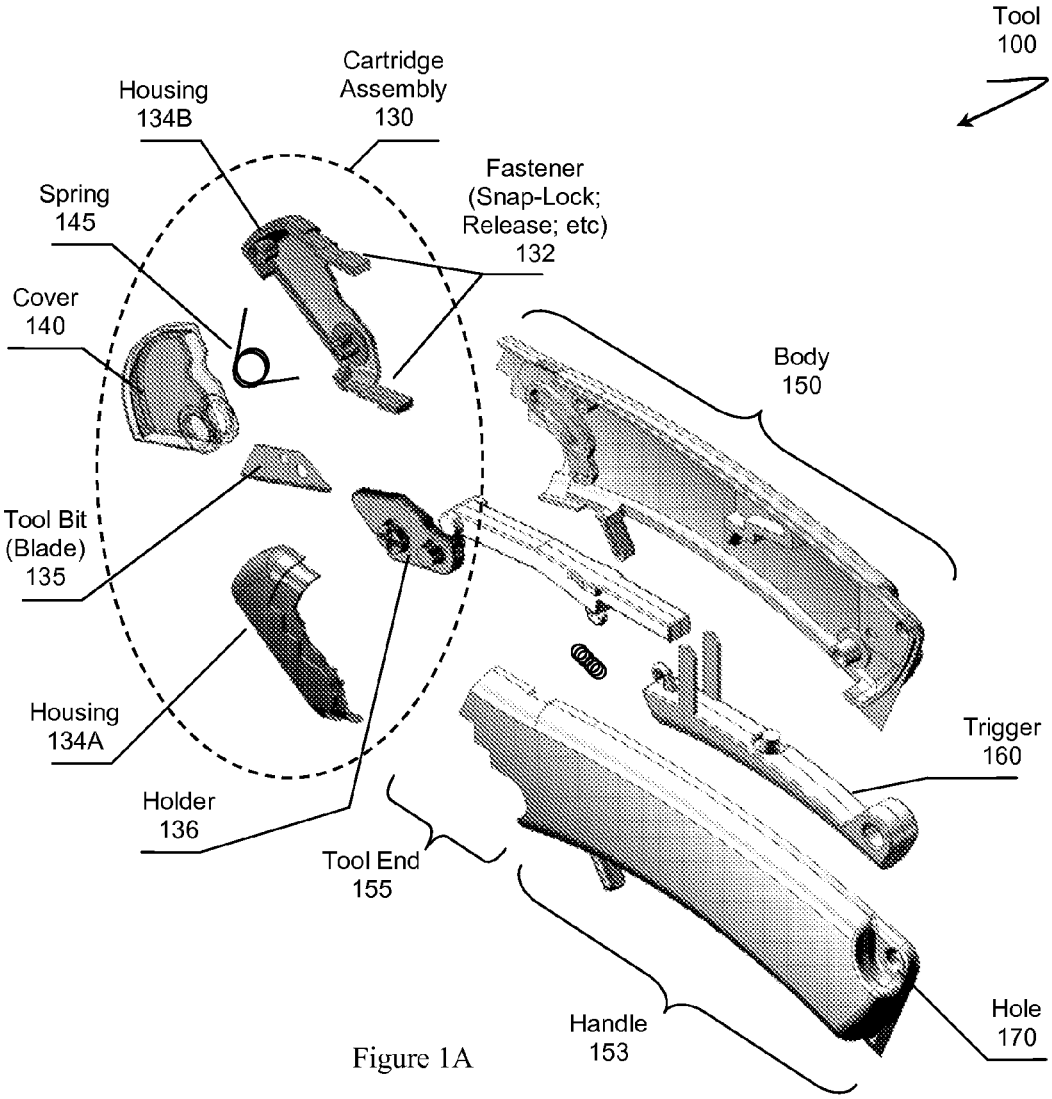
FIG. 1A is a schematic of a contemplated tool showing various components of the tool in an exploded view.

In FIG. 1A, an example tool 100 is illustrated in an exploded view to reveal various internal components. In a preferred embodiment, tool 100 comprises body 150 having tool end 155 and handle portion 153. Tool 100 also preferably has a tool cartridge comprising cartridge assembly 130 that installs into tool end 155 of body 150.

Body 150 can include one more components to form a base for a comfortable hand-held tool. As shown, body 150 is an elongated body having two sides that join together to form handle 153. In some embodiments, body 150 can also include hole 170 that can be used to hang or to carry tool 100.

Body 150 is preferably sized and dimensioned to fit within the palm of a human hand. It is also contemplated that body 150 could be manufactured in different sizes or shapes. For example, in some embodiments body 150 has a length less than about eight centimeters for use by children. In other embodiments body 150 has a length of greater than about eight centimeters for use by adults. The length, width, and breadth of body 150 can be adjusted as necessary to better fit the intended user or to fit the target use of the tool. One should also appreciate that tool 100 is preferably ambidextrous, fit for use by a right or left hand.

In a preferred embodiment, body 150 is molded from a suitable plastic material to ensure the tool is robust under use, while also being inexpensive to produce. Of course, other materials could also be used to form body 150 including wood, metal, alloys, fiber glass, or other materials. It is also contemplated that body 150 could comprise multiple different materials, functional or ornamental. For example, trigger 160 could comprise plastic while handle 153 could primarily include wood. Another example includes handle portion 153 comprising a plastic or metal frame covered with a soft, flexible coating (e.g., nitrile rubber).

Body 150 can also include an actuator that operationally engages with cartridge assembly 130. The actuator in the example shown is handle trigger 160 that can be actuated by the hand of the tool user. Although trigger 160 is shown on the inferior portion of tool 100, it should be appreciated that trigger 160 could be positioned elsewhere on body 150. Trigger 160 could remain exposed on the top where it can be actuated by a thumb, on the rear, on the sides, or other positions on body 150. It is also contemplated that trigger 160 could be concealed within body 150, where pressure applied to one or more surfaces of body 150 actuates trigger 160.

Hole 170 provides for hanging or storing tool 100. Although a preferred embodiment utilizes holes molded into the plastic forms of body 150, it is also contemplated that other configurations can achieve the same purpose. Other configurations that can be used to hang tool 100 can include hooks, loops, latches, snaps, magnetic elements, hook and loop fasteners, or other hanging systems.

A tool cartridge comprises multiple components as shown, for example, cartridge assembly 130. Assembly 130 preferably minimally comprises (1) a tool bit 135, (2) a tool bit holder 136, and (3) fastener 132. A more preferred assembly 130 also includes cover 140 that protects tool bit 135, possibly biased in a closed position by spring 145, located within cartridge assembly 130 or within body 150 (see FIG. 1B). In the example shown, assembly 130 forms a utility knife cartridge where tool bit 135 comprises a razor or knife blade. Cover 140 covers the blade to protect the user or to protect the blade from nicks when not in use. The shown cartridge snaps into tool end 155 via snap-lock fasteners 132.

Although tool bit 135 is illustrated as a knife blade, many other types of tool bits can also be employed while still falling within the scope of the inventive subject matter. Types of tool bits are discussed further in reference to FIGS. 2A and 2B.

Tool bit 135 can be held securely by tool bit holder 136. Tool bit 135 can be molded, glued, or otherwise substantially permanently affixed to holder 136 to ensure that bit 135 remains fixed relative to holder 136, especially during use. It is also contemplated that bit 135 can be releasably attached to holder 136 to provide for replaceable tool bits. However, a preferred embodiment supports replaceable or disposable cartridges as opposed to replaceable tool bits.

In a preferred embodiment, at least one cartridge of the contemplated tool system includes a cartridge assembly 130 having cover 140. Cover 140 is thought to be especially useful for tool bits 135 having sharp edges, sharp points, markers, or other surfaces that could adversely interact with a user. Preferred covers 140 are biased closed, possibly through spring 145, and securely couple to holder 136 while retaining movement ability to sheath or unsheathe tool bit 135 as desired. For example, cover 140 can securely attach to holder 136, and be held in place by housing elements 134A and 134B, collectively referred to as housing 134. Cover 140 can then pivot to slide into housing 134 exposing bit 135.

Preferred tool bit cover 140, as mentioned previously, is biased closed to substantially guard a working portion of tool bit 135. In some embodiments, cover 140 completely sheaths bit 135 to ensure the bit can not be accessed accidentally. In other embodiments cover 140 can partially sheath bit 130. It is also contemplated that cartridge assembly 130 could comprises multiple covers 140 that cooperate together to cover bit 135.

Housing 134 provides at least a partial enclosure for cartridge assembly 130, or protects the inner working of the tool cartridge. In a preferred embodiment, housing 134 remains fixed relative to body 150 when a tool cartridge is installed. In some embodiments, housing 134 includes one or more of fastener 132 that can releasably fasten to tool end 155 of body 150. In the example shown in FIG. 1A, fasteners 132 comprise snap-lock fastener tabs that insert into complementary fastener slots in body 150. Additionally, fasteners 132 securely couples with holder 136, possibly via housing 134, to hold the tool cartridge fixed relative to body 150 during use.

A tool cartridge comprising cartridge assembly 130 can be sized and dimensioned to be compact relative to body 150, in some cases less than one third the length of body 150. In some embodiments tool cartridges can be stored on or within body 150. Tool cartridges can be snapped, locked, inserted, or otherwise held securely in body 150. It is also contemplated that the end opposite of tool end 155 could also be configured to hold a cartridge. Preferably cartridges held in the opposite end keep cover 140 in a locked, closed state.

The schematic of tool 100 shown in FIG. 1A provides an example for a utility knife and should be considered for illustrative purposes. The general concepts presented including fasteners, tool bits, tool bit covers, housings, or other concepts can be extended or adapted easily by one skilled in the art for application to multiple interchangeable tool cartridges having different types of tool bits as discussed below.

Figure 1B:
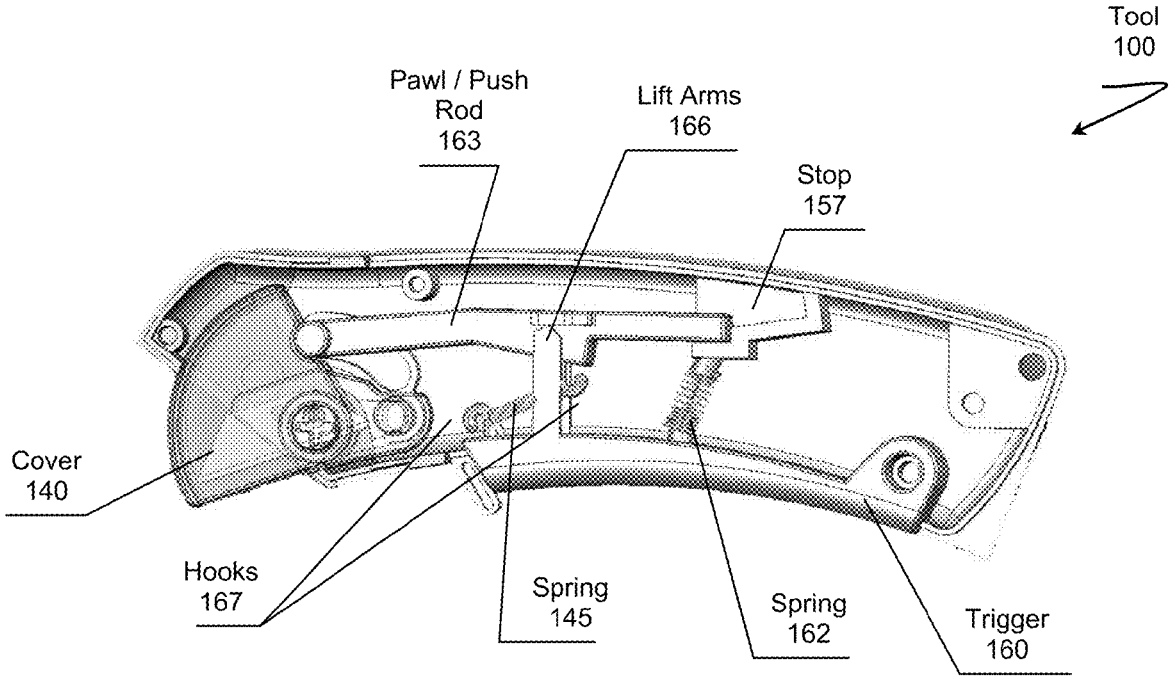
FIG. 1B is a schematic of the tool from FIG. 1A where the elements are operationally engaged.

FIG. 1B provides additional details of example tool 100, and depicts an example set of operational engagements of the various elements of tool 100. Trigger 100 operationally engages cover 140 directly or via one or more other elements. In the example shown, trigger 100 interfaces with pawl rod 160 via one or more lifting arms 166. When trigger 160 is not actuated, rod 160 remains engaged with stop 157 causing cover 140 to remain in a closed and locked position. Cover 140 can be biased closed by attaching one or more of springs 145 (e.g., metal spring, plastic spring, elastic band, etc.) to hooks 167. Trigger 160 can also be biased toward an unactuated position by spring 162 that is attached to internal posts on body 150 as shown. Upon actuation of trigger 160 (e.g., applying pressure to the inferior of portion of the trigger), lifting arms 166 raise rod 163 from its engaged position at stop 157 thereby unlocking cover 140 from its locked state. Rod 163 is free to move rearward, to within the constraints of spring 145 and upper portions of stop 157. In a preferred embodiment, even when rod 163 is disengaged with stop 157, rod 163 is still biased forward by spring 145, which in turn biases cover 140 in a closed position. As a user places tool 100 against a working surface, the pressure of the surface applied to cover 140 cause cover 140 to retract into cartridge 130, which also causes rod 163 to slide rearward, exposing the underlying tool bit. Once cutting is complete and there is no longer pressure on cover 140, cover 140 returns toward its closed state. In a preferred embodiment, cover 140 is configured to automatically return to a locked, closed position. Preferably upon return to the closed state, cover 140 again locks closed, and requires another actuation of trigger 160 to be unlocked, thereby allowing a single use per actuation of trigger 160. It should be appreciated that many other trigger-cartridge engagements can achieve the same inventive objectives, all of which are contemplated.

Trigger 160 is preferably a mechanical trigger. However, it is also contemplated that trigger 160 could also be electrically, or even magnetically engaged with the elements of cartridge 130. Although, trigger 160 is illustrated as a lever that pivots with respect to body 150, trigger 160 could take on different forms. Other contemplated triggers could include a slider, a button, a protrusion, a hidden trigger, or other form that can be operationally engaged with cover 140.

Figure 1C:
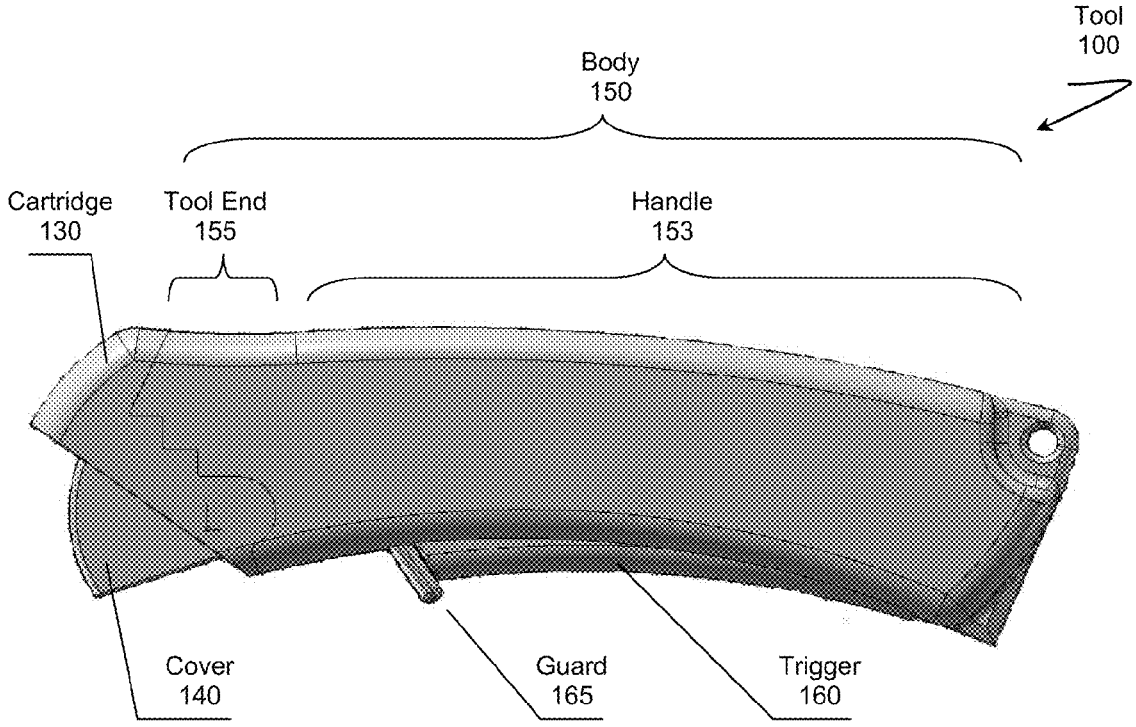
FIG. 1C is a side view illustrating the tool from FIG. 1A with a tool cartridge installed and ready for use.

FIG. 1C provides an illustration of tool 100 from FIG. 1A once the various elements tool 100 are properly assembled, and where tool 100 is ready for use. Tool 100 can be operated safely and easily by a human user. The user can grasp handle portion 153 of body 150. When the user is ready to use tool 100, they can simply actuate trigger 160 which unlocks cover 140 and allows the cover to move relative to the tool bit holder internal to cartridge 130. The user can place the tool against a working surface. The force of the work surface moves the cover, exposing the tool bit. In some embodiments, tool 100 also includes one or more guards 165 to prevent a user's hand from slipping forward during use.

Figure 2A:
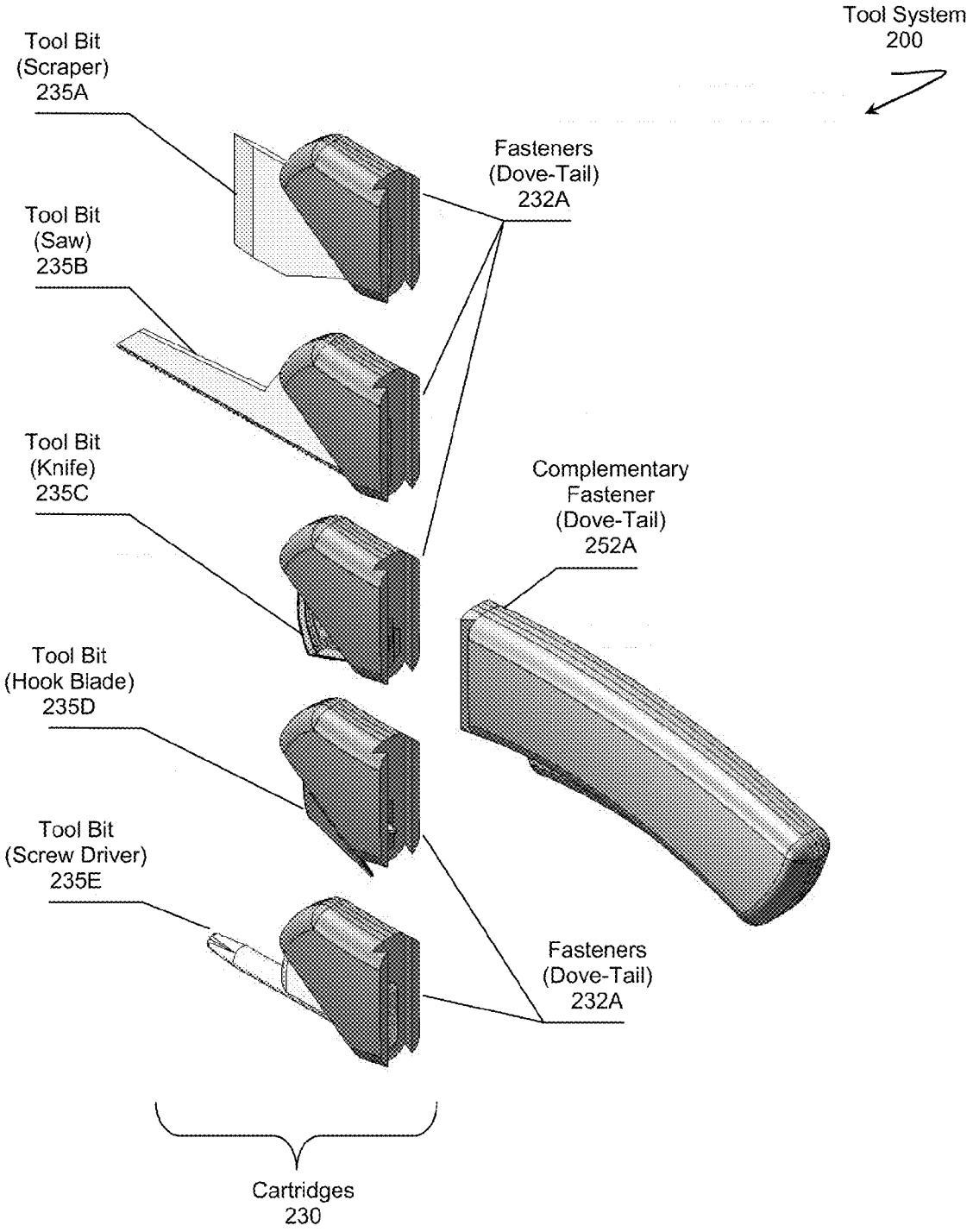
FIG. 2A is a schematic of a tool system have interchangeable tool cartridges that attach to the tool body via a dove-tail fastener assembly.

In FIG. 2A, an embodiment of tool system 200 comprises a plurality of interchangeable cartridges 230, each comprising elements of the cartridge assemblies discussed above. The tool system illustrated comprises scraper 235A, saw 235B, knife 235C, hook blade 235D, or screw driver 235E, collectively referred to as tool bits 235. Each of the cartridges 230 also includes fastener 232A that can releasably mate with one or more of complementary fasteners 252A on or in the tool body.

Of the many myriad ways in which tool cartridges 230 can be installed on the tool body, the example shown illustrates a dove-tail assembly. Fastener 232A can slide down over complementary fastener 252A to create a secure, preferably locked coupling.

Figure 2B:
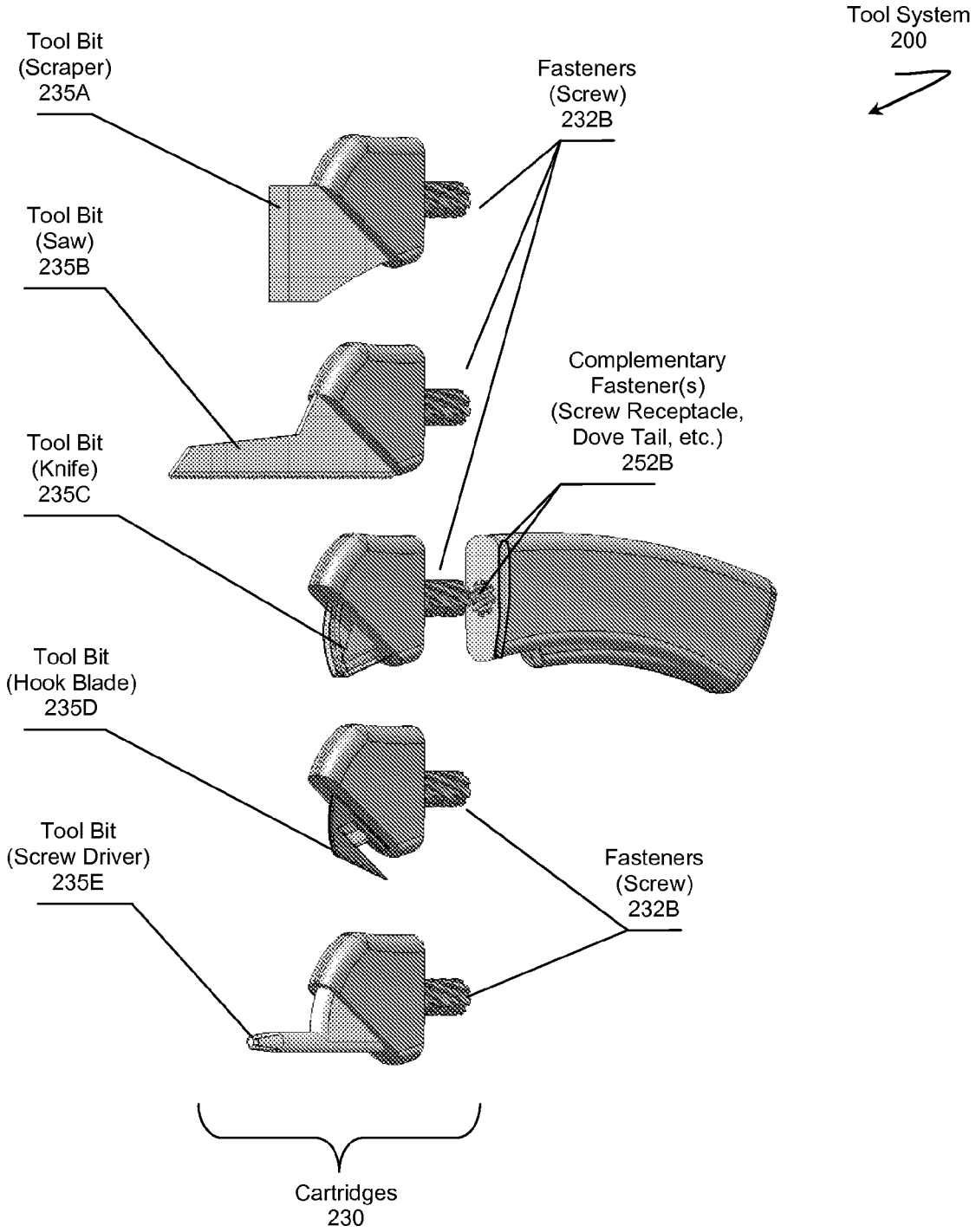
FIG. 2B is a schematic of a tool system have interchangeable tool cartridges that attach to the tool body via a screw fastener assembly.

In FIG. 2B, an embodiment of example tool system 200 utilizes a different type of fastener. Cartridges 230 can also employ screw fasteners 232B that mate with screw receptacle 252B in the body of tool 200. One should appreciate that many other types of fasteners are also contemplated. For example, cartridges 230 could also employ a key assembly that inserts and locks into a receptacle within the tool body, or vice versa. In yet other embodiments, fasteners can include a stem assembly as contemplated in parent patent application U.S. patent application having Ser. No. 10/818,661 filed on Apr. 5, 2004, which is now U.S. Pat. No. 7,475,480 issued on Jan. 13, 2009.

It is specifically contemplated that a tool body within tool system 200 could employ multiple, different types of complementary fasteners, where some tool cartridges 230 would benefit from one type of complementary fastener while other cartridges having different tool bits might benefit from a different type of complementary fastener. For example, a screw driver cartridge might be better served with a dove-tail fastener assembly that providers greater support for rotational stresses. However, a saw blade cartridge might be better served with a key fastener assembly or screw fastener assembly that is more robust against back and forth motion coupled with a downward force. In some embodiments, a single tool body could support coupling to at least two different types of cartridge fasteners (e.g., dove-tail, and screw). In other embodiments, a single tool body can support coupling to at least three types of cartridge fasteners (e.g., dove-tail, stem, and snap-lock). Such approaches are though to be beneficial when the different types of complementary fasteners on the tool body do not substantially interfere with each other, and retain desired strength of the body of the tool. Preferably different types of complementary fasteners are commonly located at the tool end of the body. However, it is also contemplated that the different complementary fasteners could be located at opposite ends of the tool body. It is further contemplated that a complementary fastener could be located on a side of the tool body. For example, a corkscrew tool cartridge would likely be better served by attaching to approximately central point in the tool body to provide sufficient leverage during use.

Although only five tool bits 235 are shown, one should appreciate that many different types of tool bits can be utilized within the contemplated tool systems. Contemplated types of tool bits and examples include:

(A) Cutting: utility knife blades, hook blades, saws, multiple blades (e.g., scissors, shears, etc.), scrapers, chisels, scalpels, etc.

(B) Rotating: screw driver heads (e.g., star, hex, Philips, flat head etc.), drill bits, sockets, etc.

(C) Dispensing: chalk reservoir, tape dispenser, etc.

(D) Lighting: lights (e.g., LEDs, bulbs), magnifying glass, etc.

(E) Marking: pen, marker, pencil, etc.

(F) Gripping: pliers, wrench, etc.

(G) Other: hammers, punches, awls, etc.

It should be appreciated that some tool cartridges 230 might include covers (e.g., those having sharp points, sharp edges, markers, etc.) and some might not (e.g., pliers, hammer, screw driver heads, etc.).

Cartridges 230 can also be considered disposable. Once tool bits 235 become damaged or worn out, the entire cartridge can be disposed of safely, possibly by locking their cover in a closed position. Given the disposable nature of cartridges, it is also contemplated many of the interchangeable cartridges can be packaged for sale separately from body of tool 200. Cartridges can be packaged homogeneously where all the cartridges have the same type of tool bits, or heterogeneously where the packaged cartridges comprise different types of tool bits.

Figure 3:
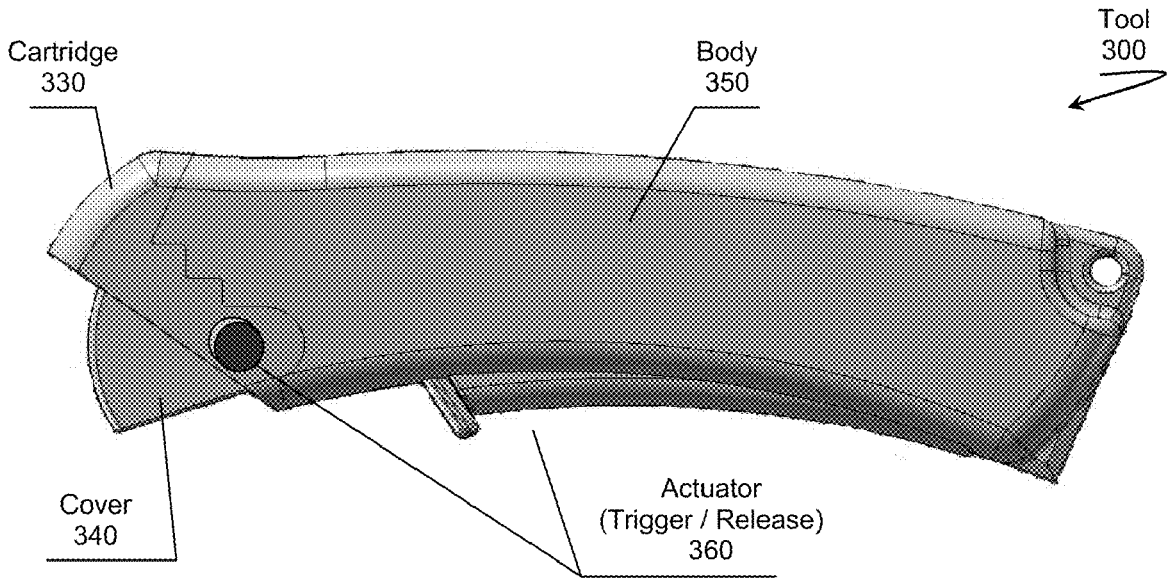
FIG. 3 is a schematic of a tool having an actuator located on the tool cartridge or on the tool body.

In FIG. 3, illustrates an embodiment where example tool 300 includes one or more actuators 360 that operationally engage with cartridge 330. In one preferred embodiment, actuator 360 can include a trigger that unlocks tool bit cover 340. In other embodiments, actuator 360 can include a cartridge release that allows cartridge 330 to be decoupled from body 350. In yet other embodiments, the tool 300 could include both a trigger and a cartridge release.

In a preferred embodiment, actuator 360 comprises a trigger that unlocks cover 340. It should be noted that the term "unlock" within this context means that cover 340 is released from a locked state, and can now move to reveal the tool bit. Consider an example where cartridge 330 includes a utility knife blade. Upon actuation of the trigger, cover 340 is unlocked, and is free to move to within limits of any internal constraints (e.g., a spring that biases cover 340 toward a closed position), but only moves when under an external influence. Pressure from a work surface causes cover 340 to pivot and to recess into the housing of cartridge 330. In a less preferred embodiment, actuation of trigger 360 can unlock cover 340 as well as move cover 340 to expose the underlying tool bit without requiring pressure from a work surface.

It is specifically contemplated, that tool 300 can be configured where single actuation of a trigger allows for only a single use of the tool. Once the tool has been used (e.g., a single cut of a utility knife), cover 340 can lock back into a closed position. Another use requires a second actuation of the trigger. A more detailed discussion of such an approach can be found in co-owned patent application having Ser. No. 10/300,382 titled "Safety Cutting Apparatus".

Actuator 360 can be placed in any desirable location. In a preferred embodiment a trigger for unlocking cover 340 is placed on body 350. In embodiments having a cartridge release, it is thought that the cartridge release would be better placed on cartridge 330 so that the release can complement the type of fastener used to fasten cartridge 330 to body 350. This is especially beneficial in embodiments where tool 300 includes multiple, different complementary fasteners capable of coupling to different types of cartridges.

Figure 4:
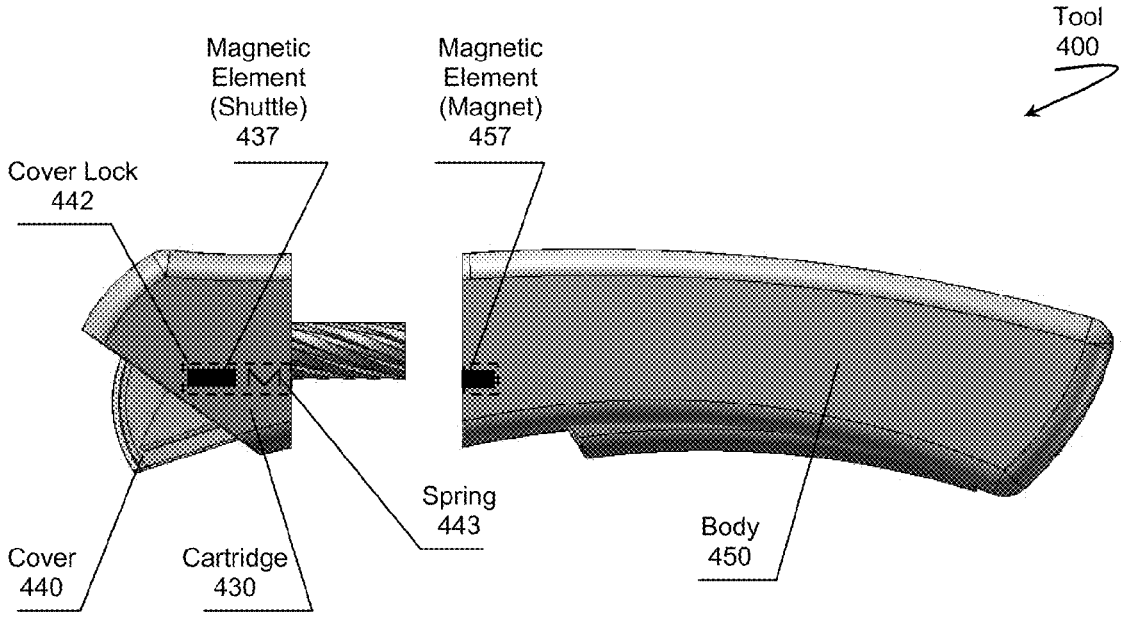
FIG. 4 is a schematic of a tool comprising a cartridge with a cover locking component.

In FIG. 4, an embodiment of example tool 400 has cartridge 430 that includes an additional cover locking component 442 that keeps cover 440 in a locked, closed position, sheathing the underlying tool bit, when cartridge 440 is not installed in body 450. Locking component 442 preferably couples to the tool holder to ensure a secure lock over the tool bit. Locking component 442 can be mechanical, electrical, or even magnetic. Such an approach ensures that cover 440 does not accidentally unsheathe the underlying tool bit exposing users to the risk of injury. Locking component 442 can comprise levers, springs, shuttles, or other mechanical devices. All cover locking components are contemplated.

In the sample shown in FIG. 4, locking component 442 comprises one or more magnetic elements 437, possibly a magnetic shuttle (e.g., a sliding metal element). The shuttle can be biased in a locked position by a small, non-magnetic spring 443. Furthermore, body 450 can include a second magnetic element 457 (e.g., a magnet). As cartridge 440 is installed into body 450, the magnetic attraction between elements 437 and 457 cause element 437 to slide into an unlocked position, thereby freeing cover 440 for use. A magnetic cover locking component is thought to provide an advantage over a mechanical locking component because such an approach requires less mechanical interconnections between cartridge 440 and body 450.

One should note that it is contemplated that locking component 442 simply enables use of the tool bit within cartridge 430 does not necessarily unlock cover 440 for actual use. For example, tool 400 can also employ a trigger to unlock cover 440 for a single use as discussed above. In this sense locking component 442 can be considered independent of the trigger locking system.

Figure 5:
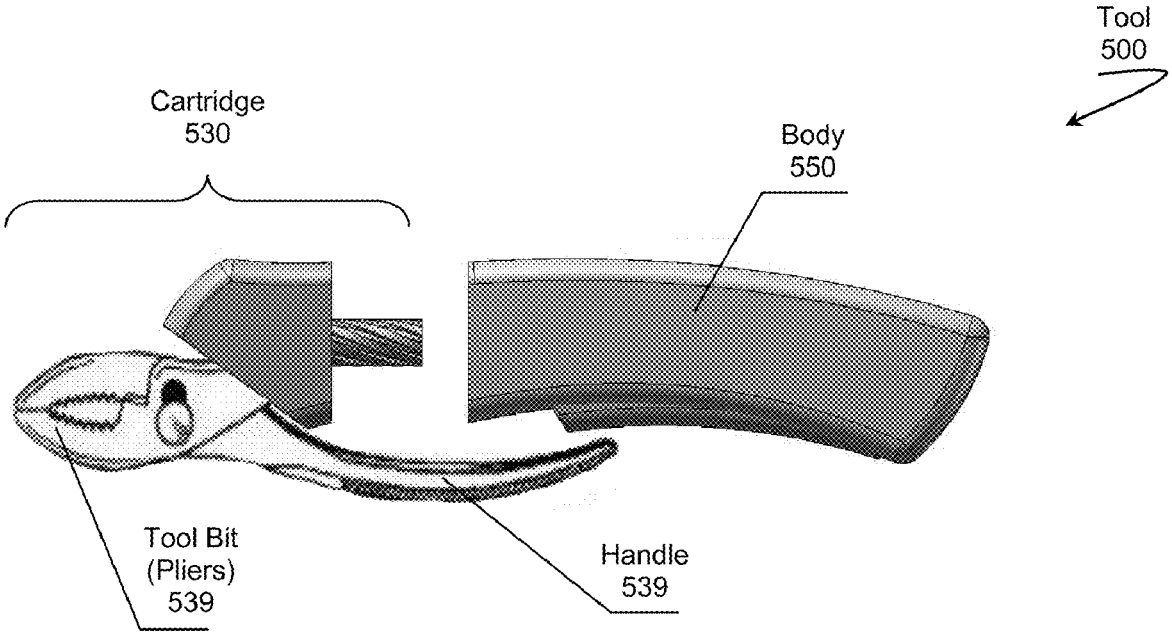
FIG. 5 is a schematic of a tool having a tool cartridge that includes a second tool handle.

FIG. 5 provides an illustration of yet another embodiment where example tool 500. In the example shown, tool 500 comprises a cartridge 530 having an elongated handle 539. Handle 539 provides a second handle that is approximately co-planar with body 550 of tool 500. Movement of the handle 539 relative to body 550 operates tool bit 535 of cartridge 530. For example, cartridge 530 and handle 539 can form pliers as shown, shears, scissors, clippers, or other multi-handled tools even those supporting multiple blades.

Figure 6:
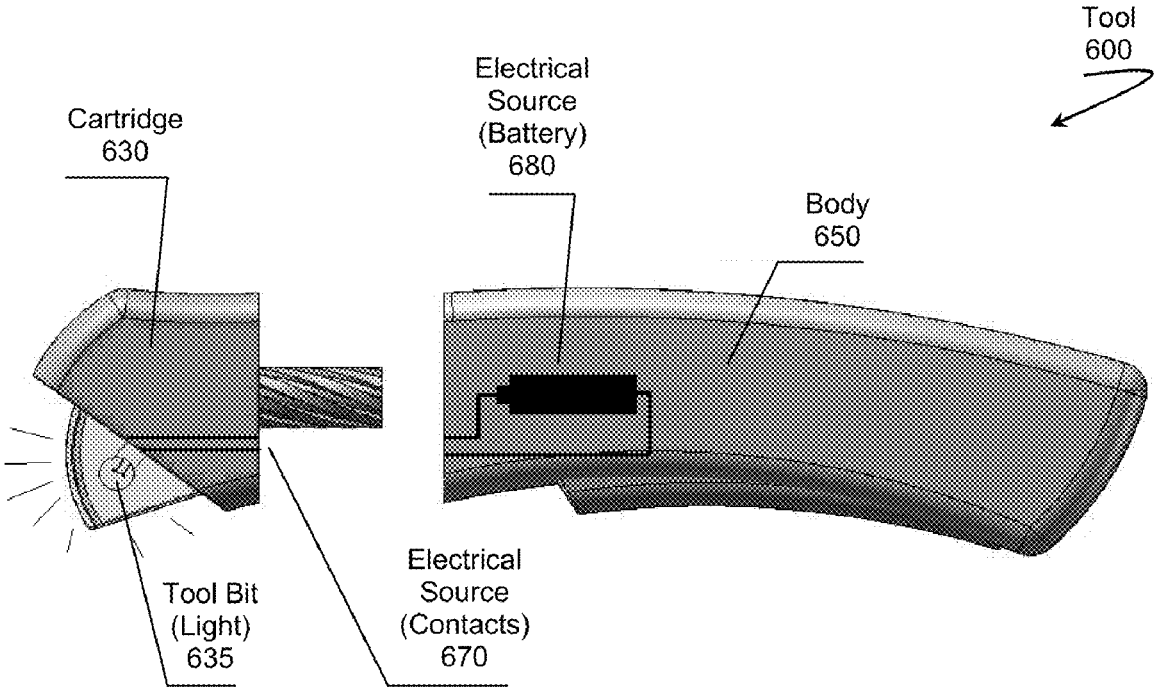
FIG. 6 is a schematic of a tool having a tool cartridge that includes access to an electrical energy source.

FIG. 6 depicts yet another embodiment where example tool 600 includes tool cartridge 630 having lighting tool bit 635. Cartridge 630 provides one or more electrical contacts 670 that routes electricity to tool bit 635. The source of electricity can be in body 650 as illustrated by battery 680 or could be located in cartridge 630 itself. Lighting tool bit 635 could include a lamp, one or more LEDs, or other low cost light emitting elements.

In view of the above discussion, many of the advantages of the inventive subject matter become clear. Tool cartridges in the contemplated tool systems can have tool bit covers to protect the user or the tool bit. Users are protected when replacing tool bits or when disposing of used tool bits. Additionally, others are protected from dangerous used tool bits once disposed. For example, rather than disposing of a used solo knife blade that could penetrate a garbage bag and could injure a person, the cover of a knife blade cartridge can be locked closed upon disposal thus reducing the risk of potential injuries. Furthermore, the tool bits are protected from damage while being stored. For example, tool cartridges can be placed in a tool box with many other tools. As the tool box is moved, the tool bits are protected from damage due to random movement of other tools.

Contemplated tools can also support multiple types of complementary fasteners, which ensures that each type of tool cartridge can securely fasten to a tool body in a manner that is more aligned with the intended use of the cartridge's tool bit. This approach provides an advantage over other known multi-function tools by reducing of fatigue to weak points in the tool-tool bit interface.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A hand-held tool system comprising:

an elongated body having a handle portion and a tool end configured to receive functionally different first and second interchangeable user removal tool cartridges, each tool cartridge comprising a cartridge assembly of:

(a) a tool bit, (b) a tool bit holder that securely holds the tool bit fixed relative to the holder, (c) a retractable tool bit cover coupled to the tool bit holder and biased toward a closed position when the tool bit is not in use and when the cartridge is not coupled to the elongated body, and (d) a housing securely coupled to the tool bit holder and having a fastener configured to releasably fasten the tool cartridge to the tool end of the body; and wherein the tool bit cover mechanically engages with a trigger disposed on the elongated body, where actuation of the trigger unlocks the cover and allows the cover to move freely relative to the tool bit holder from a closed position covering the tool bit to an open position that exposes the tool bit for use.

2. The tool system of claim 1, wherein the cover is configured to automatically lock in a closed position after use.

3. The tool system of claim 2, wherein actuation of the trigger unlocks the cover allowing the cover to retract for a single application of the tool bit per trigger actuation.

4. The tool system of claim 1, wherein the handle portion is configured to hold one or more of the tool cartridges when the cartridges are not in use.

5. The tool system of claim 1, wherein the cartridge assembly further comprises a cartridge release whereon operating the release allows the fastener to be decoupled from the body.

6. The tool system of claim 1, wherein the fastener comprises a stem that inserts into a receptacle within the handle portion and snaps into position.

7. The tool system of claim 1, wherein the fastener comprises a screw fastener.

8. The tool system of claim 1, wherein the fastener comprises a dove-tail assembly.

9. The tool system of claim 1, wherein the fastener comprises a snap-lock.

10. The tool system of claim 1, wherein one of the cartridges comprises a first magnetic element.

11. The tool system of claim 10, wherein the elongated body comprises a second magnetic element whose interaction with the first magnetic element enables use of the tool bit.

12. The tool system of claim 1, wherein the tool end comprises a complimentary fastener that securely fastens with the fastener, and locks the cartridge in a fixed position relative to the body during use.

13. The tool system of claim 12, wherein tool end comprises at least two different types of complimentary fasteners.

14. The tool system of claim 1, wherein the functionally different first and second interchangeable tool cartridges are packaged for sale separately from the body of the tool.

15. The tool system of claim 1, wherein the tool bit of at least one of the cartridges comprises a cutting type of tool bit.

16. The tool system of claim 15, wherein the cutting tool bit comprises a blade.

17. The tool system of claim 15, wherein the cutting tool bit comprises a hooked blade.

18. The tool system of claim 1, wherein the tool bit of at least one of the cartridges comprise a rotating type of tool bit.

19. The tool system of claim 1, wherein the tool bit of at least one of the cartridges comprise a marking type of tool bit.

20. The tool system of claim 1, wherein the tool bit of the cartridge assembly is releasably attached to the tool bit holder.

21. The tool system of claim 1, wherein the cartridge assembly further provides the tool bit access to an electrical energy source.

22. The tool system of claim 21, wherein the energy source is disposed within the body.

23. The tool system of claim 1, wherein the cartridge assembly further comprises an elongated second handle approximately coplanar with the body of the tool, and where movement of the second handle relative to the body operates the tool bit.

24. The tool system of claim 1, wherein the tool bit of the first cartridge is a cutting tool, and the tool bit of the second cartridge is not a cutting tool.

25. The tool system of claim 1, wherein at least one of the first and second cartridges is removable without disassembly of the handle portion.

* * * * *